US006782880B2

(12) United States Patent
Schmied

(10) Patent No.: US 6,782,880 B2
(45) Date of Patent: Aug. 31, 2004

(54) IGNITION SYSTEM AND METHOD FOR OPERATING AN IGNITION SYSTEM

(75) Inventor: Helmut Schmied, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 63 days.

(21) Appl. No.: 10/298,190

(22) Filed: Nov. 13, 2002

(65) Prior Publication Data

US 2003/0121509 A1 Jul. 3, 2003

(30) Foreign Application Priority Data

Nov. 14, 2001 (DE) ..... 101 55 972

(51) Int. Cl.[7] ..... F02N 3/02
(52) U.S. Cl. ..... 123/652; 123/655
(58) Field of Search ..... 123/652, 655

(56) References Cited

U.S. PATENT DOCUMENTS 5,265,580 A * 11/1993 Vogel et al. ..... 123/655
5,638,799 A * 6/1997 Kiess et al. ..... 123/637
5,970,965 A * 10/1999 Bentel et al. ..... 123/656

* cited by examiner

*Primary Examiner*—Mahmoud Gimie
*Assistant Examiner*—Arnold Castro
(74) *Attorney, Agent, or Firm*—Kenyon & Kenyon

(57) ABSTRACT

An ignition system and a method for operating an ignition system provides reliable suppression of a closing spark ignition at relatively small expense and to achieve a reliable ignition by the ignition spark. To assure a high energy supply to the spark plug, an ignition system is created having a functional device for receiving a drive signal and for producing a pulse signal, an ignition transistor for receiving the pulse signal, an ignition coil, whose primary winding connections are connected in a primary current circuit that is fed by a vehicle power supply source and that can be switched using the ignition transistor, and whose secondary winding connections are connected in a secondary current circuit for receiving a spark plug. In the secondary current circuit, a component is provided that a) lets through a forward current in its forward direction that may be induced by reducing the magnetic field of the ignition coil, b) blocks in its blocking direction without a previous forward current, and c) over a conducting period, after a previous forward current maintains in its blocking direction a current that is suitable for maintaining an ignition process.

12 Claims, 2 Drawing Sheets

IGNITION SYSTEM AND METHOD FOR OPERATING AN IGNITION SYSTEM

FIELD OF THE INVENTION

The present invention relates to an ignition system for a motor vehicle and a method for operating an ignition system of a motor vehicle.

BACKGROUND INFORMATION

In ignition systems for motor vehicles, a magnetic field may be generated in an ignition coil by a primary current and may then be momentarily switched off, as a result of which the magnetic field may break down and, in the ignition coil functioning as transformer, a high secondary voltage may be generated that may result in the production of the ignition spark in the spark plug of the secondary current circuit. However, it may be problematic that when the primary current is switched on, or started up, a secondary voltage—having the opposite sign of the desired ignition voltage—may be induced, which, as a closing spark (energizing spark), may lead to the generation of a spark at the spark plug.

This potential ignition from a closing spark may have different significance in the different ignition systems. In ignition systems, whose primary circuit is supplied by the vehicle power supply source, i.e., the vehicle battery, some 100 $\mu$s may be required in order to build up the magnetic field at sufficient energy for the initiation and maintenance of the ignition process during the desired ignition duration. Therefore, ignition from the closing spark may still occur in the compression phase, perhaps while the intake valve is open, and may have serious consequences. Because the induced cut-in (sealing) voltage may have the opposite polarity from the ignition voltage that is induced in response to the breakdown of the magnetic field, a closing spark may be effectively suppressed using a CSS (closing-spark-suppression) diode in the secondary circuit.

In an AC ignition (ACI) system, the primary current circuit may be supplied with high voltage from an energy source, greater than 150 V for example, for which purpose a complex and expensive transformer may be required. A comparatively shorter drive signal that is emitted at a later point in time may bring about, in a functional device, the generation of a plurality of short, sequential pulse packets, which may drive the ignition transistor and which may create in the primary current circuit a sequence of essentially saw-tooth-shaped current pulses. Because the charging process in ACI may be short and may begin late, a pre-ignition from the closing spark may only result in the ignition process commencing somewhat earlier than an ignition that occurs in response to the immediately following voltage drop of the first pulse. Therefore, in an ACI, a CSS diode may not be required. As a result of the plurality of sequential primary current pulses and the secondary current pulses that are induced therefrom, energy may be fed continuously to the spark plug even after the commencement of the ignition, so as to make available sufficient energy over the ignition period.

However, in the ACI, the use of the complex and expensive transformer may be undesired. Furthermore, expensive components such as capacitors and power switches may be required in the secondary current circuit for voltages over 1000 V.

In a pulse train ignition (PTI) just as in an ACI, the ignition transistor is driven by a functional device having a timing element, as a result of which in the primary current circuit a sequence of essentially saw-tooth-shaped, or trapezoidal, current pulses may be generated. However, because the primary current circuit, just as in the case of other ignition systems, is applied with power from the vehicle battery, i.e., the vehicle electrical system, the charging process of the ignition coil may be significantly lengthened by the primary current circuit in comparison to the ACI, so that an ignition by the closing spark during the compression stroke may have catastrophic consequences, such as, for example, when the intake valve is open. Therefore,—just as in the case of other ignition systems without a pulse sequence—a CSS diode may be connected in the secondary current circuit so that a closing spark that is induced in response to the start-up of the primary current may be blocked in the secondary current circuit, and the ignition current may be let through that is induced in the secondary current circuit in response to the sudden voltage drop after the first primary current pulse.

However, when the CSS diode is used in the secondary current circuit, the secondary voltage pulses that are induced by the succeeding primary current pulses may only be partially relayed to the spark plug as secondary current pulses. The CSS diode may only admit current pulse packets that have the same polarity as the ignition voltage—i.e., during the blocking period of the ignition transistor—so that the energy supply to the spark plugs may be significantly reduced and may be interrupted over time, as a result of which it may become more difficult to maintain the ignition spark over the desired spark period.

SUMMARY OF THE INVENTION

According to an exemplary ignition system and exemplary method for operating an ignition system, the closing spark may be reliably suppressed and nevertheless a high energy supply may be assured to the spark plug during the ignition process. This may be achieved on the basis of relatively low effort and cost.

According to an exemplary embodiment and/or exemplary method of the present invention, in the secondary current circuit a component may therefore be used that reliably suppresses a closing spark during the initiation of the charging process, since previously no voltage was applied at the component in the through direction, and therefore no forward current was flowing. Subsequently, in response to the falling edge of the primary current and the breakdown of the magnetic field of the ignition coil, the induced ignition current may be reliably let through in the forward direction, as a result of which the component is permeated by charge carriers. If the ignition spark is burning and the ignition transistor is once again switched on, the component—other than in a pulse train ignition—may remain conductive even during the recharge period, in response to voltage that is originally applied in the blocking direction.

In this manner, on the one hand, a reliable functioning of the ignition system may be assured—suppressing the closing spark and letting through the ignition spark—and, on the other hand, the energy supply to the spark plug may be maintained during the recharge period.

According to an exemplary embodiment of the present invention, any component that has the desired properties may be used as the component. In particular—but not exclusively—this component may be a break-over diode or triac (bidirectional thyristor triode). In this context, the triac may be connected as a diode (transistor diode), in that its gate is connected to a main electrode and therefore may form the anode.

The component according to an exemplary embodiment of the present invention may therefore differ in principle from the diodes that are used in other prior systems for suppressing closing sparks, that only have a capacitative behavior but that do not let through sufficient current in the blocking direction for maintaining a spark current. According to an exemplary embodiment and/or exemplary method of the present invention, the minimum hold-off interval of the component may be larger than the period of the secondary voltage increase after the ignition transistor is once again connected (or switched on).

According to an exemplary embodiment and/or exemplary method of the present invention, therefore, in the secondary current circuit a component may be used that is fundamentally a blocking-type one but that is sufficiently slow-acting from the point of view of dynamic behavior, whose properties may be matched to the dimensioning of the ignition coil and to the system voltage used, such that the recharge pulses are let through, but no charge carriers remain after the termination of the ignition process until the commencement of the next ignition process, so that the generation of a closing spark may be reliably prevented in response to a subsequent buildup of the primary current.

In contrast to an AC ignition, the complex and costly transformer for generating a higher voltage for the primary current circuit may be omitted. Furthermore, using the component, a more reliable determination of the commencement of the ignition process may be provided than in the case of an ACI, because the ignition may not be produced by the closing spark. In this context, the extra expense of the component, such as, for example, when a triac or a breakover diode is used, may be small in comparison to an ACI.

In comparison to pulse train ignition, an open energy supply to the spark plug may be provided, the overall energy supply may be significantly increased, and therefore the ignition process may be improved. Furthermore in the ignition system according to an exemplary embodiment of the present invention, the polarity of the secondary voltage may be changed, so that the first—and therefore most powerful—secondary current may not result in increased burnup in the spark plug, and an ion current evaluation may be performed, if it is employed, using a positive measuring voltage.

DETAILED DESCRIPTION

Figure 1:
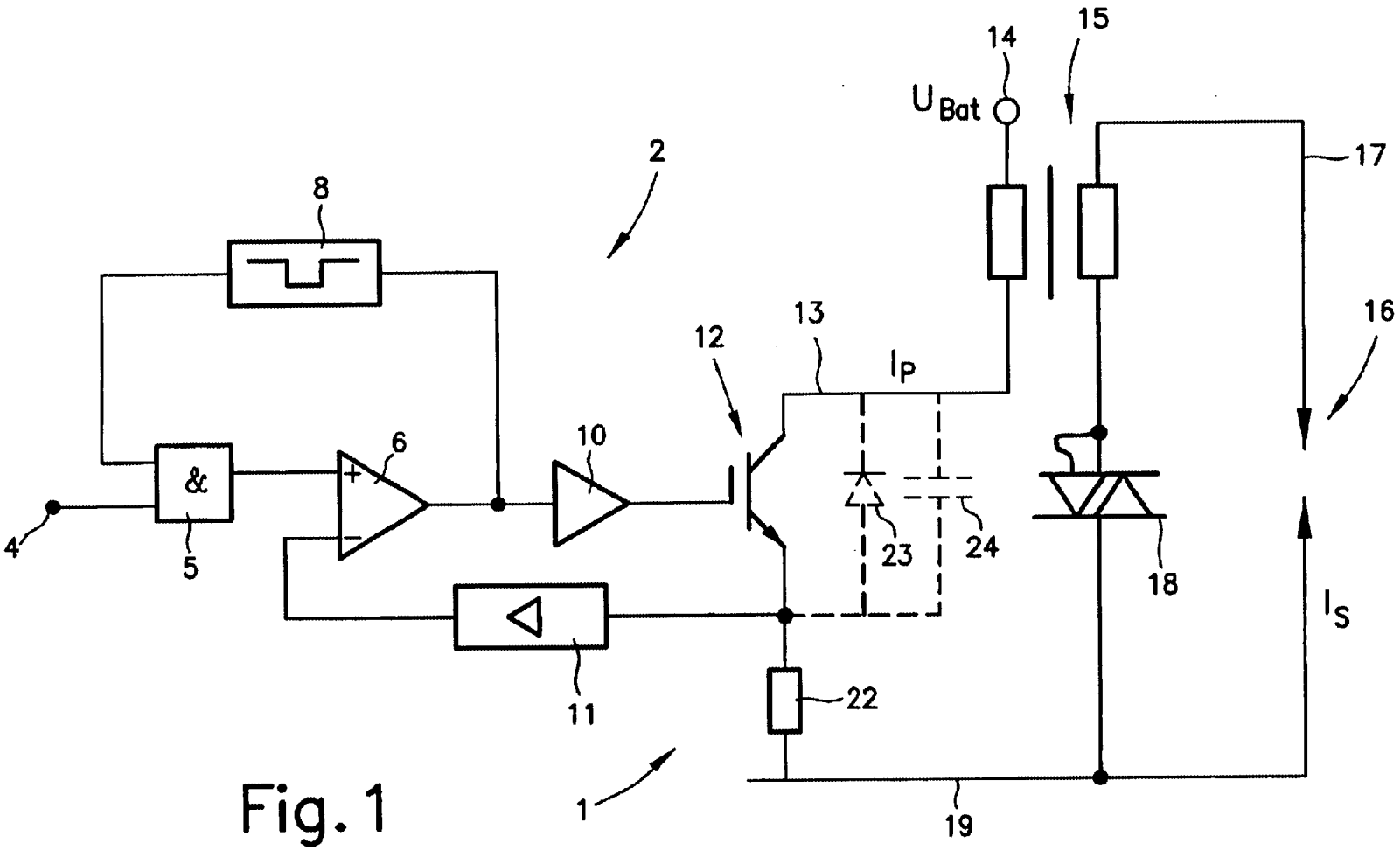
FIG. 1 shows a circuit diagram of an ignition system in accordance with one exemplary embodiment of the present invention.

According to FIG. 1, ignition system 1 according to an exemplary embodiment of the present invention has a functional device 2 having an operational amplifier 6, a timing element 8 that is connected to the feedback path of operational amplifier 6, and an AND gate 5. The inputs of AND gate 5 are connected to signal terminal 4 and timing element 8 and its output is in contact with the non-inverting input of operational amplifier 6. The output of operational amplifier 6 via a driver device 10 contacts the gate of an FET that functions as ignition transistor 12. In this context, ignition transistor 12 controls the primary current of a primary current circuit 13. Primary current circuit 13 is arranged between a battery terminal clamp 14 and ground line 19 and is therefore supplied only with the vehicle power supply of, e.g., 12 V. In primary current circuit 13, primary winding connections of an ignition coil 15 and a shunt resistor 22 are provided. The (power) source of ignition transistor 12 is connected via a current sensing device 11 to the non-inverting input of operational amplifier 6. In addition, in the primary current circuit leading to ignition transistor 12, a diode 23 and a capacitor 24 may be connected in parallel.

The secondary winding connections of ignition coil 15 are connected in a secondary current circuit 17, on the one hand, directly to spark plug 16 and, on the other hand, via a triac 18 to the other terminal of spark plug 16. In this context, the gate terminal of triac 18 is connected to one of its two main electrodes, so that it functions as a diode having both the forward and blocking properties that are described below.

Figure 2:
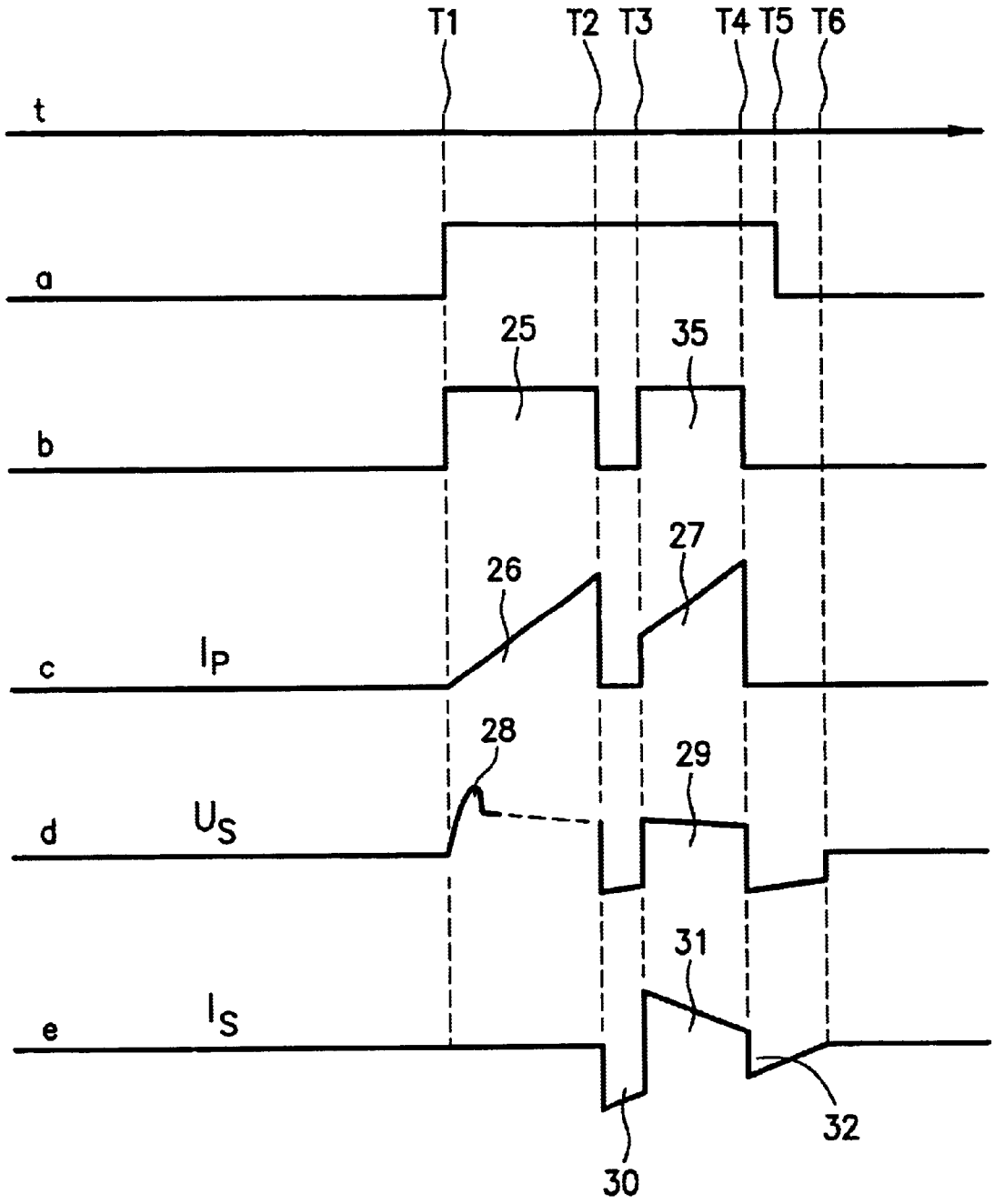
FIG. 2 shows temporal curves of the drive signal (a), the input signal (b) at the gate of the ignition transistor, the primary current (c), the secondary voltage (d), and the secondary current (e).

According to an exemplary embodiment of the present invention, in the operation of the internal combustion engine, the drive signal depicted in FIG. 2*a* is applied at signal terminal 4. The drive signal up to a time point T1 is at a low voltage level and between a time point T1 and T5 is at a high voltage level. Functional device 2 in accordance with FIG. 2*b* generates two square-wave voltage pulses during the period from T1 to T5, i.e., a first square-wave voltage pulse 25 between T1 and a time point T2 and a second square-wave voltage pulse 35 between a time point T3 and a time point T4. Ignition transistor 12 is driven by this gate drive signal, depicted in FIG. 2*b*, which, at the low voltage drop at shunt resistor 22, essentially corresponds to the gate source voltage. In this manner, ignition transistor 12 at time point T1 is driven from the high-resistive state to the low-resistive state, so that in accordance with FIG. 2*c*, a primary current Ip having a first primary voltage pulse 26 is built up, and as a result a magnetic field is generated in ignition coil 15. The temporal rise of primary current Ip in this context is determined by the primary inductance of ignition coil 15. When primary current Ip is switched on at time point T1, in the secondary winding, in accordance with FIG. 2*d*, a first secondary voltage pulse 28 is induced, that has a cut-in voltage spike and then a somewhat sinking voltage. However, in contrast to secondary voltage Us, triac 18 is connected in the blocking direction, as is indicated by the dotted signal curves of secondary voltage Us between T1 and T2. Therefore—as may be seen from FIG. 2*e*—there is no secondary current Is, i.e., there is a negligible blocking current, that does not result in an ignition of spark plug 16.

At time point T2, primary current Ip reaches its setpoint value, and drive signal b of FIG. 2*b* that is supplied by functional device 2 abruptly falls at ignition transistor 12 from the positive voltage level to the negative voltage level (ground), so that ignition transistor 12 becomes high-resistive and immediately blocks primary current Ip in accordance with FIG. 2*c*. In this manner, the magnetic field in ignition coil 15 breaks down and induces a high secondary voltage Us in a manner in accordance with FIG. 2*d*. Because the induced ignition voltage is the opposite, with regard to the sign, i.e., the polarity, of the cut-in voltage induced between T1 and T2, triac 18 is conductive, so that the ignition voltage is applied at spark plug 16 and ignites it. Therefore, between T2 and T3 a first phase of the power startup is permitted by triac 18 through secondary current Is, that is depicted in FIG. 2*e* and that has a secondary current pulse 30. As a result of the forward current, triac 18 is permeated by charge carriers between T2 and T3.

At time point T3, functional device 2 via timing element 8, in accordance with FIG. 2*b*, delivers second positive voltage pulse 35, which modulates (or controls) ignition transistor 12 and results in second primary voltage pulse 27. In this manner, a magnetic field is once again created in ignition coil 15 and, in accordance with FIG. 2*d*, between T3 and T4 a positive pulse 29 of secondary voltage Us is induced. In this context, triac 18—just as between T1 and T2—is once again connected in the blocking direction. However, because charge carriers are still present in it from the previous forward current, a corresponding secondary current Is may be created in the blocking direction, the secondary current supplying ignition coil 16 with current once again—now having reversed polarity—in current pulse 31, of FIG. 2*e*, until time point T4, at which drive signal b, of FIG. 2*b*, once again drops at ignition transistor 12, as a result of which, in accordance with FIG. 2*c*, a voltage drop of second primary current pulse 27 is generated, which causes the magnetic field to break down, and as a result once again in accordance with FIG. 2*d* a negative secondary voltage Us is induced, which in the forward direction of triac 18 leads to a secondary current pulse 32 in accordance with FIG. 2*c*. The state of the circuit in the time segment between T4 and T5 is the same as between T2 and T3. Because in T5 drive signal 2*a* was switched to "OFF," ignition transistor 12 may no longer be driven and the energy remaining in the coil is completely removed by time point T6, i.e., at T6 the spark is extinguished. In one modified exemplary embodiment that may have a longer-lasting, active drive signal 2*a*, the segments T2 to T4 may be accordingly repeated.

In using the triac, a component is therefore employed that, in contrast to the CSS diodes used in a pulse train ignition, may offer the possibility of placing its blocking capacity out of operation in a controlled manner. In place of a triac, e.g., a break-over diode may be used.

Therefore, secondary current Is, depicted in FIG. 2*e*, in the time periods until T1, between T1 and T2, and between T2 and T3, corresponds to a secondary current of a pulse train ignition. Between T3 and T4 and in response to any subsequent voltage pulses 2*b* at the gate of ignition transistor 12, the ignition system according to an exemplary embodiment of the present invention and PTI are different from each other in this respect. Therefore, the overall energy supply to the spark plug rises, and also it is continuous and not only pulsed.

The temporal behavior of secondary current Is, from FIG. 2*e*, of the ignition system according to an exemplary embodiment of the present invention corresponds to that of an AC ignition, longer charging times arising due to the lower supply voltage $U_{BAT}$, which—in place of an expensive transformer—supplies the primary current.

What is claimed is:

1. An ignition system for a motor vehicle, comprising:

a functional device to receive a drive signal and to output a pulse signal;

an ignition transistor to receive the pulse signal;

a vehicle power supply source;

an ignition coil having primary winding connections connected in a primary circuit fed by the vehicle power supply source and switchable using the ignition transistor, and secondary winding connections connected in a secondary circuit including a spark plug and a component;

wherein the component is configured to:

permit a forward current induced in a forward direction by reducing a magnetic field of the ignition coil;

block in a blocking direction without the previous forward current; and after the previous forward current, maintain a current that is suitable for maintaining an ignition process over a conducting period in the blocking direction.

2. The ignition system of claim 1, wherein the conducting period in the blocking direction extends over at least one recharge pulse of a secondary voltage, the at least one recharge pulse being configured to follow an ignition voltage pulse that is induced by switching off the magnetic field of the ignition coil.

3. The ignition system of claim 2, wherein the at least one recharge pulse is reverse-biased in the blocking direction of the component.

4. The ignition system of claim 1, wherein a hold-off interval of the component is configured to be not less than a minimum value after the ignition transistor is switched on again.

5. The ignition system of claim 1, wherein the component includes a break-over diode.

6. The ignition system of claim 1, wherein the component includes a triac.

7. The ignition system of claim 6, wherein the triac is arranged as a diode having a main electrode and a gate coupled to the main electrode to form an anode.

8. The ignition system of claim 1, further comprising:

an ion-current measuring device.

9. A method for ignition of an internal combustion engine, the method comprising:

generating a primary current having a plurality of pulses in a primary current circuit;

inducing a secondary current in an ignition coil with a component;

permitting the secondary current in a forward direction as forward current;

blocking the secondary current in a blocking direction as a blocking current without the preceding forward current; and permitting the secondary current in the blocking direction after the preceding forward current over a conductive period to maintain an ignition process.

10. The method of claim 9, further comprising:

switching off a magnetic field to induce an ignition voltage pulse;

configuring at least one recharge pulse of a secondary voltage to follow the ignition voltage pulse; and configuring the conductive period to extend over the at least one recharge pulse.

11. The method of claim 9, further comprising:

configuring a hold-off interval of the component to be not less than a minimum value after an ignition transistor is switched on again.

12. The method of claim 9, further comprising:

interrupting the ignition process if a drive signal is switched off.

* * * * *